US006281890B1

(12) United States Patent
Ito

(10) Patent No.: US 6,281,890 B1
(45) Date of Patent: Aug. 28, 2001

(54) LIQUID CRYSTAL DRIVE CIRCUIT AND LIQUID CRYSTAL DISPLAY SYSTEM

(75) Inventor: Junji Ito, Oita (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/098,375

(22) Filed: Jun. 17, 1998

(30) Foreign Application Priority Data

Jun. 19, 1997 (JP) ..... 9-162986

(51) Int. Cl.[7] ..... G09G 3/36
(52) U.S. Cl. ..... 345/204; 345/98; 345/100
(58) Field of Search ..... 345/204, 98, 89, 345/90, 94, 55; 713/330; 326/81

(56) References Cited

U.S. PATENT DOCUMENTS 5,454,114 * 9/1995 Yach et al. ..... 713/330
5,852,370 * 12/1998 Ko ..... 326/81

* cited by examiner

*Primary Examiner*—Steven Saras
*Assistant Examiner*—Uchendu O. Anyaso
(74) *Attorney, Agent, or Firm*—Foley & Lardner

(57) ABSTRACT

A liquid crystal panel is turned on upon power ON, and wastes electric power.

A liquid crystal drive circuit of this invention has a shift register (111) for receiving an input signal IN and a clock CLK, and shifting the signal IN, an output selection circuit (112) for receiving a shifted signal Q1 and a frame signal FR, and outputting signals SEL1 to SEL4, an output buffer (113) for receiving the signals SEL1 to SEL4 and voltages V1 to V4, and outputting one of these voltages, a selection control circuit (21) for receiving signals Q157 to Q160 output from shift register units in four continuous blocks from the final stage, and for determining abnormal operation and outputting signals S1 and /S1 when all the input signals are at a predetermined level, and a clock control circuit (12) for inputting a given signal to the shift register unit (111) upon reception of the signals S1 and /S1 so as to make the shift register unit (111) operate as an inverter array. Usually, upon power ON, the internal signals assume unknown values, and the liquid crystal panel wastes electric power if it is turned on in such state. When the liquid crystal panel is set in a non-display state by the above arrangement, however, consumption power can be reduced.

20 Claims, 11 Drawing Sheets

LIQUID CRYSTAL DRIVE CIRCUIT AND LIQUID CRYSTAL DISPLAY SYSTEM

BACKGROUND OF THE INVENTION

The present invention relates to a liquid crystal drive circuit for outputting a voltage for driving a liquid crystal, and a liquid crystal display system including the circuit.

As a device which selects one of four different voltages V1 to V4 for driving a liquid crystal panel and outputs the selected voltage, and to which the present invention pertains, the device shown in FIG. 8 is known. This device comprises, e.g., 160 blocks BL1 to BL160 each including a shift register unit 111 for shifting an input signal IN, an output selection circuit 112 for determining the voltage to be output to the liquid crystal panel, and an output buffer 113 for outputting the voltage determined by the output selection circuit 112.

The shift register unit 111 has a shift register including an inverter IN51 for receiving a clock CLK and outputting an inverted clock /CLK, clocked inverters CIN51 to CIN54 which are enabled/disabled in response to the input clocks CLK and /CLK, and inverters IN52 and IN53. When the clocked inverter CIN51 is enabled in response to the clock CLK, the input signal IN is inverted and output. When the clocked inverter CIN51 is disabled, the clocked inverter CIN53 is enabled to hold the output state of the inverter IN52. This output is inverted by the clocked inverter CIN52, and is inverted again by the inverter IN53. When the clocked inverter CIN52 is disabled, the clocked inverter CIN54 is enabled to hold the output form the inverter IN53. The output from the inverter IN53 is supplied to the output selection circuit 112 as an output signal Q1 of the shift register unit 111.

The output selection circuit 112 receives the output signal Q1 from the shift register unit 111, and a frame signal FR, the level of which is inverted in units of frames. Two-input NAND gates NA61 to NA64 receive one of the frame signal FR and its inverted signal /FR obtained via an inverter IN71, and one of the output from the shift register unit 111 and its inverted signal obtained via an inverter IN72, and respectively supply their outputs to the output buffer 113 as switching control signals SELL to SEL4.

The output buffer 113 receives four different voltages V1 to V4, and the switching control signals SEL1 to SEL4 output from the output selection circuit 112, and selects and outputs one voltage to be supplied to a liquid crystal panel (not shown) on the basis of the signals SEL1 to SEL4. The switching control signals SEL1 to SEL4, and signals /SEL1 to /SEL4 respectively inverted by inverters IN61 to IN64 are supplied to switching elements SW61 to SW64 each constituted by a combination of p- and n-MOS transistors to turn on one of these switching elements. In this way, the selected one of the four voltages V1 to V4 is output as an output voltage OUT1.

In other blocks BL2 to BL160 as well, the shift register units 111 generate signals Q2 to Q160, and supply them to the output selection circuits 112. The output selection circuits 112 output switching signals SEL1 to SEL4, and the output buffers 113 output the selected voltages. Note that the signals Q1 to S160 in the shift register units 111 in the blocks BL1 to BL160 have shifts toward the latter stages.

The voltages V1 to V4 are generated by a power supply circuit shown in FIG. 9. A predetermined power supply voltage $V_{DD}$ and ground voltage $V_{ss}$ are supplied to a DC-DC converter 101 to generate a voltage $V_{GG}$. The voltage $V_{GG}$ is input to an emitter-follower circuit including a resistor 102, variable resistor 108, and a pnp bipolar transistor 113 to output a voltage $V_{EE}$. The potential difference between the voltages $V_{GG}$ and $V_{EE}$ is divided by the resistances of five fixed resistors 103 to 107, and four sets of operational amplifiers 109 to 112, resistors 114 to 117, and capacitors 118 to 121 output stabilized voltages V1 to V4.

However, the liquid crystal drive circuit shown in FIG. 8 suffers the following problems. After the power supply is turned on and the power supply voltage stabilizes, data is input from a terminal IN, and the clock CLK is input from a clock terminal CLK. Then, the shift register units 111 are enabled to shift the data, and the values of the output signals Q1 to Q160 of the shift register units of all the blocks are determined. A long period of time is required from when the power supply is turned on until the values of the signals Q1 to Q160 are determined, and the signal values remain unknown during this interval. For this reason, whether or not the liquid crystal panel applied with one of the voltages V1 to V4 at its scanning electrodes is turned on is finally uncertain.

If the liquid crystal panel is turned on upon power ON, electric power is wasted during this interval. Furthermore, since an unnecessary current path is formed in the power supply circuit shown in FIG. 9 in this case, the rise time required until the power supply voltage reaches a prescribed level is prolonged. As described above, the liquid crystal drive circuit shown in FIG. 8 suffers the problems including an increase in consumption power and a decrease in display response speed of the liquid crystal panel.

SUMMARY OF THE INVENTION

It is, therefore, an object of the present invention to provide a liquid crystal drive circuit which can prevent an increase in consumption power upon power ON, and can increase the display response speed of a liquid crystal panel, and a liquid crystal display system including the circuit.

According to the present invention, there is provided a liquid crystal drive circuit comprising a shift register unit for receiving an input signal and clock, and outputting a signal obtained by shifting the input signal on the basis of the clock, an output selection circuit for receiving the signal output from the shift register unit, and a frame signal, and outputting a switching control signal, an output buffer for receiving the switching control signal, and at least two different voltages, and selecting and outputting one of the input voltages on the basis of the switching control signal, a selection control circuit for receiving the signal output from the shift register unit, and for, when the signal has a predetermined value, determining abnormal operation and generating a selection control signal; and a clock control circuit for, when the selection control circuit generates the selection control signal, inputting a signal having a given value to the shift register unit in place of the clock to make the shift register unit operate as an inverter array.

Note that the selection control circuit may determine abnormal operation and generate a selection control signal when a predetermined one of signals output from the shift register unit assumes a value which makes the output buffer output a display voltage for setting the liquid crystal panel in a display state.

Alternatively, the selection control circuit may include an AND gate or NAND gate which receives a plurality of predetermined signals of the signals output from the shift register unit, and may output the selection control signal when all the input signals have values for making the liquid crystal panel display, the clock control circuit may include an OR gate or NOR gate for receiving the selection control signal output from the selection control circuit, and the clock, and an AND gate or NAND gate for receiving a signal obtained by inverting a polarity of the selection control signal, and the clock, and when the OR gate or NOR gate and the AND gate or NAND gate receive the selection control signal from the selection control circuit, the OR gate or NOR gate and the AND gate or NAND gate may output signals having the given value to the shift register unit.

A liquid crystal drive circuit according to the present invention comprises a first block having a first shift register unit for receiving an input signal and a clock, and outputting a signal obtained by shifting the input signal on the basis of the clock, a first output selection circuit for receiving the signal output from the first shift register unit and a frame signal, and outputting a switching control signal, and a first output buffer for receiving the switching control signal output from the first output selection circuit, and at least two different voltages, and selecting and outputting one of the input voltages on the basis of the switching control signal output from the first output selection circuit, a second block having a second shift register unit for receiving the signal output from the first shift register unit of the first block, and the clock, and outputting a signal obtained by shifting the signal output from the first shift register unit on the basis of the clock, a second output selection circuit for receiving the signal output from the second shift register unit and a frame signal, and outputting a switching control signal, and a second output buffer for receiving the switching control signal output from the second output selection circuit, and at least two different voltages, and selecting and outputting one of the input voltages on the basis of the switching control signal output from the second output selection circuit, . . . , an n-th block having an n-th shift register unit for receiving the signal output from an (n−1)-th shift register unit (n is an integer not less than 2) of an (n−1)-th block, and the clock, and outputting a signal obtained by shifting the signal output from the (n−1)-th shift register unit on the basis of the clock, an n-th output selection circuit for receiving the signal output from the n-th shift register unit and a frame signal, and outputting a switching control signal, and an n-th output buffer for receiving the switching control signal output from the n-th output selection circuit, and at least two different voltages, and selecting and outputting one of the input voltages on the basis of the switching control signal output from the n-th output selection circuit, a selection control circuit for receiving the signal output from at least one of the first to n-th shift register units, and for, when the received signal has a predetermined value, determining abnormal operation and generating a selection control signal, and a clock control circuit for, when the selection control circuit generates the selection control signal, inputting a signal having a given value to the shift register unit in place of the clock, and making the first shift register unit operate as an inverter array.

The selection control circuit may receive signals output from the m-th to n-th shift register units, and may determine abnormal operation and generate a selection control signal when all the received signals have a value for making the m-th to n-th output buffers in the corresponding blocks output display voltages for setting the liquid crystal panel in a display state.

Also, the selection control circuit may include an AND gate or NAND gate which receives signals output from the m-th to n-th shift register units, and may output the selection control signal when all the input signals have values for making the liquid crystal panel display, the clock control circuit may include an OR gate or NOR gate for receiving the selection control signal output from the selection control circuit, and the clock, and an AND gate or NAND gate for receiving a signal obtained by inverting a polarity of the selection control signal, and the clock, and when the OR gate or NOR gate and the AND gate or NAND gate receive the selection control signal from the selection control circuit, the OR gate or NOR gate and the AND gate or NAND gate may output signals having the given value to the first shift register unit.

A liquid crystal drive circuit according to the present invention comprises a shift register unit having a first clocked inverter, an operation state of which is switched on the basis of a first clock, and which receives an input signal, a first inverter for receiving an output from the first clocked inverter, a second clocked inverter, an operation state of which is switched on the basis of a second clock, and which receives an output from the first inverter, a second inverter for receiving an output from the second clocked inverter, a third clocked inverter, an operation state of which is switched on the basis of the first clock, and input and output terminals of which are respectively connected to output and input terminals of the first inverter, and a fourth clocked inverter, an operation state of which is switched on the basis of the second clock, and input and output terminals of which are respectively connected to output and input terminals of the second inverter, the shift register unit outputting a first signal from the second inverter, an output selection circuit having a first NAND gate for receiving an inverted frame signal obtained by inverting a frame signal, and the first signal, a second NAND gate for receiving the frame signal and the first signal, a third NAND gate for receiving the inverted frame signal and an inverted first signal obtained by inverting the first signal, and a fourth NAND gate for receiving the frame signal, and the inverted first signal, an output buffer having a first switching element, an ON/OFF state of which is switched on the basis of an output from the first NAND gate, and which outputs a first voltage when it is ON, a second switching element, an ON/OFF state of which is switched on the basis of an output from the second NAND gate, and which outputs a second voltage when it is ON, a third switching element, an ON/OFF state of which is switched on the basis of an output from the third NAND gate, and which outputs a third voltage when it is ON, and a fourth switching element, an ON/OFF state of which is switched on the basis of an output from the fourth NAND gate, and which outputs a fourth voltage when it is ON, the output buffer selecting and outputting one of the first, second, third, and fourth voltages on the basis of the outputs from the first, second, third, and fourth NAND gates, a selection control circuit for receiving the first signal output from the shift register unit, and for, when the first signal assumes a predetermined value, determining abnormal operation and generating a selection control signal, and a clock control circuit for, when the selection control circuit generates the selection control signal, inputting a signal having a given value to the shift register unit in place of the clock so as to make the shift register unit operate as an inverter array.

A liquid crystal drive circuit according to the present invention comprises a first block having a first shift register unit for receiving an input signal and a clock, and outputting a signal obtained by shifting the input signal on the basis of the clock, a first output selection circuit for receiving the signal output from the first shift register unit and a frame signal, and outputting a switching control signal, and a first output buffer for receiving the switching control signal output from the first output selection circuit, and at least two different voltages, and selecting and outputting one of the input voltages on the basis of the switching control signal output from the first output selection circuit, a second block having a second shift register unit for receiving the signal output from the first shift register unit of the first block, and the clock, and outputting a signal obtained by shifting the signal output from the first shift register unit on the basis of the clock, a second output selection circuit for receiving the signal output from the second shift register unit and a frame signal, and outputting a switching control signal, and a second output buffer for receiving the switching control signal output from the second output selection circuit, and at least two different voltages, and selecting and outputting one of the input voltages on the basis of the switching control signal output from the second output selection circuit , . . . , an n-th block having an n-th shift register unit for receiving the signal output from an (n−1)-th shift register unit (n is an integer not less than 2) of an (n−1)-th block, and the clock, and outputting a signal obtained by shifting the signal output from the (n−1)-th shift register unit on the basis of the clock, an n-th output selection circuit for receiving the signal output from the n-th shift register unit and a frame signal, and outputting a switching control signal, and an n-th output buffer for receiving the switching control signal output from the n-th output selection circuit, and at least two different voltages, and selecting and outputting one of the input voltages on the basis of the switching control signal output from the n-th output selection circuit, and a control circuit for, when all the signals output from a plurality of predetermined shift register units of the first to n-th shift register units assume a value for making the output buffers in the blocks corresponding to the plurality of shift register units output display voltages to the liquid crystal panel, controlling to internally convert the output signals from the plurality of shift register units into a value that make the output buffers output non-display voltages to the liquid crystal panel.

The control circuit may control all of the first to n-th shift register units to output a signal having a value that make all of the first to n-th output buffers output non-display voltages to the liquid crystal panel.

A liquid crystal display system according to the present invention comprises a liquid crystal panel which has segment electrodes disposed in units of pixels in a matrix, and a common electrode disposed to face the segment electrodes so as to sandwich a liquid crystal therebetween, and operates upon application of a segment voltage to the segment voltages, and a common voltage to the common electrode, a common voltage generation circuit for receiving at least two different voltages, selecting one of the input voltages, and supplying the selected voltage to the liquid crystal panel as the common voltage, and a segment voltage generation circuit for receiving at least two different voltages, selecting one of the input voltages, and supplying the selected voltage to the liquid crystal panel as the segment voltage, the common voltage generation circuit includes a shift register for receiving an input signal and a clock, and outputting a signal obtained by shifting the input signal on the basis of the clock signal, an output selection circuit for receiving the signal output from the shift register unit, and a frame signal, and outputting a switching control signal, an output buffer for receiving the switching control signal, and the at least two different voltages, and selecting and outputting one of the input voltages on the basis of the switching control signal, a selection control circuit for receiving the signal output from the shift register unit, and for, when the signal has a predetermined value, determining abnormal operation and generating a selection control signal, and a clock control signal for, when the selection control circuit generates the selection control signal, inputting a signal having a given value to the shift register unit in place of the clock to make the shift register unit operate as an inverter array, and when the clock control circuit outputs the signal having the given value and inputs the signal to the clock control circuit, the common voltage generation circuit outputs a voltage for setting the liquid crystal panel in a non-display state.

Furthermore, a liquid crystal display system according to the present invention comprises a liquid crystal panel, a common voltage generation circuit, and a segment voltage generation circuit, the segment voltage generation circuit includes a shift register for receiving an input signal and a clock, and outputting a signal obtained by shifting the input signal on the basis of the clock signal, an output selection circuit for receiving the signal output from the shift register unit, and a frame signal, and outputting a switching control signal, an output buffer for receiving the switching control signal, and the at least two different voltages, and selecting and outputting one of the input voltages on the basis of the switching control signal, a selection control circuit for receiving the signal output from the shift register unit, and for, when the signal has a predetermined value, determining abnormal operation and generating a selection control signal, and a clock control signal for, when the selection control circuit generates the selection control signal, inputting a signal having a given value to the shift register unit in place of the clock to make the shift register unit operate as an inverter array, and when the clock control circuit outputs the signal having the given value and inputs the signal to the clock control circuit, the segment voltage generation circuit outputs a voltage for setting the liquid crystal panel in a non-display state.

As described above, when the output signals of the shift register units indicate a combination of values that never occur in normal operation, the liquid crystal drive circuit of the present invention determines abnormal operation during the interval from when the power supply is turned on until the power supply voltage becomes stable, and sets all the liquid crystal display voltages at non-display voltages to set the liquid crystal panel in a non-display state, thus attaining power savings, and preventing formation of a wasteful current path to realize a short rise time of the liquid crystal display voltage.

DESCRIPTION OF THE PREFERRED EMBODIMENTS

The preferred embodiments of the present invention will be described hereinafter with reference to the accompanying drawings.

Figure 1:
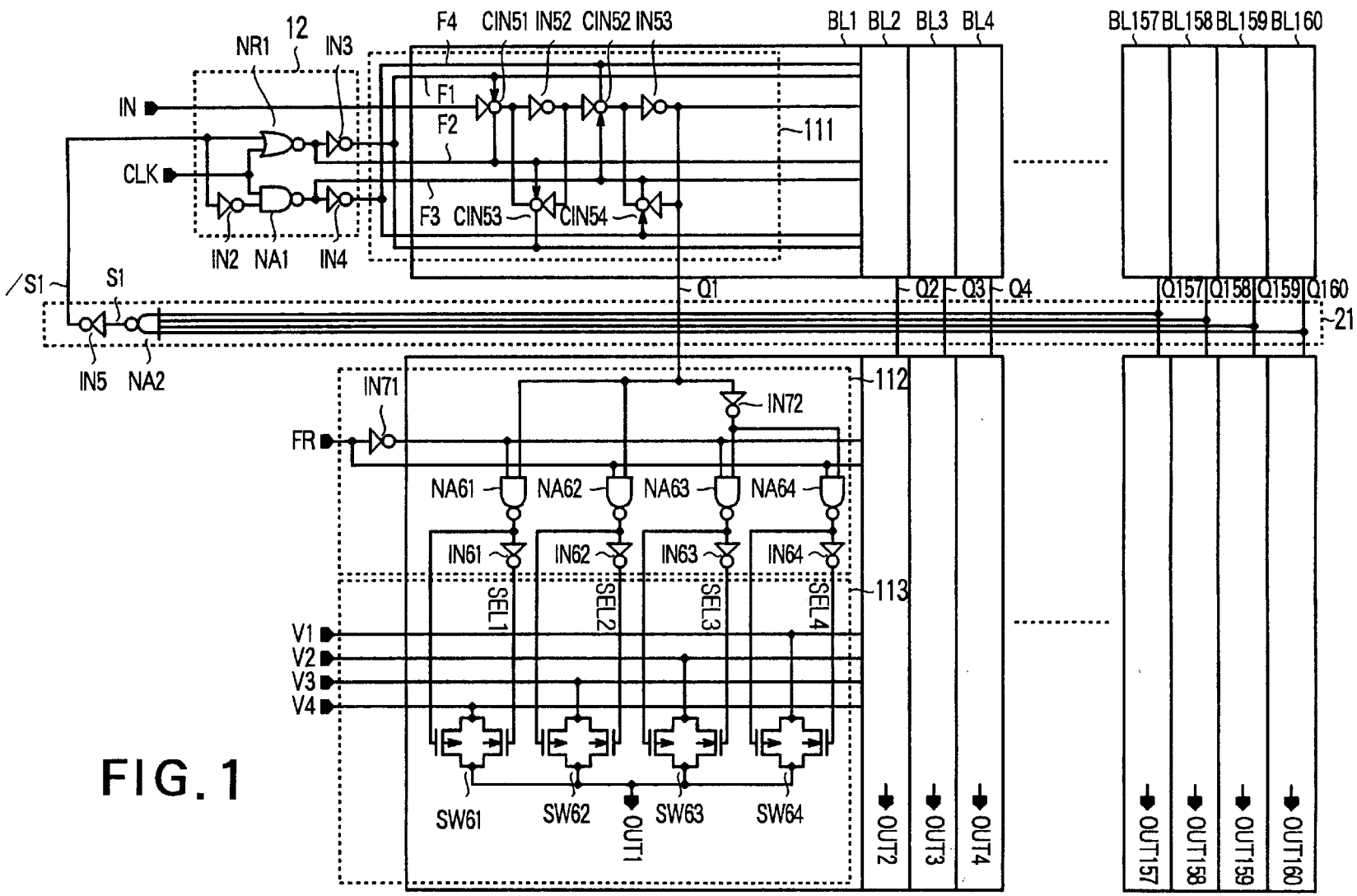
FIG. 1 is a circuit diagram showing the arrangement of a liquid crystal drive circuit according to the first embodiment of the present invention.
Figure 8:
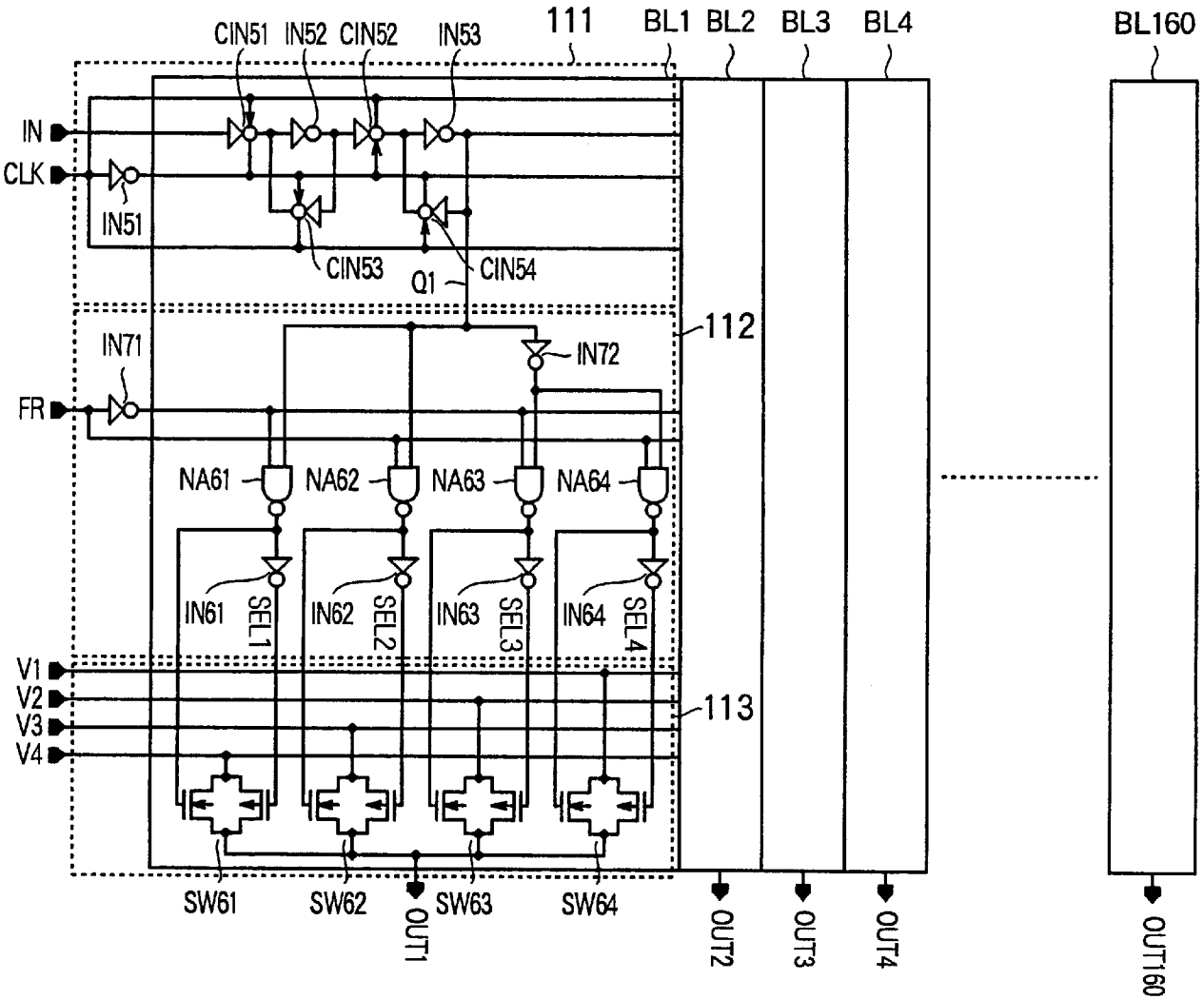
FIG. 8 is a circuit diagram showing the arrangement of a liquid crystal drive circuit to which the present invention is directed.
Figure 9:
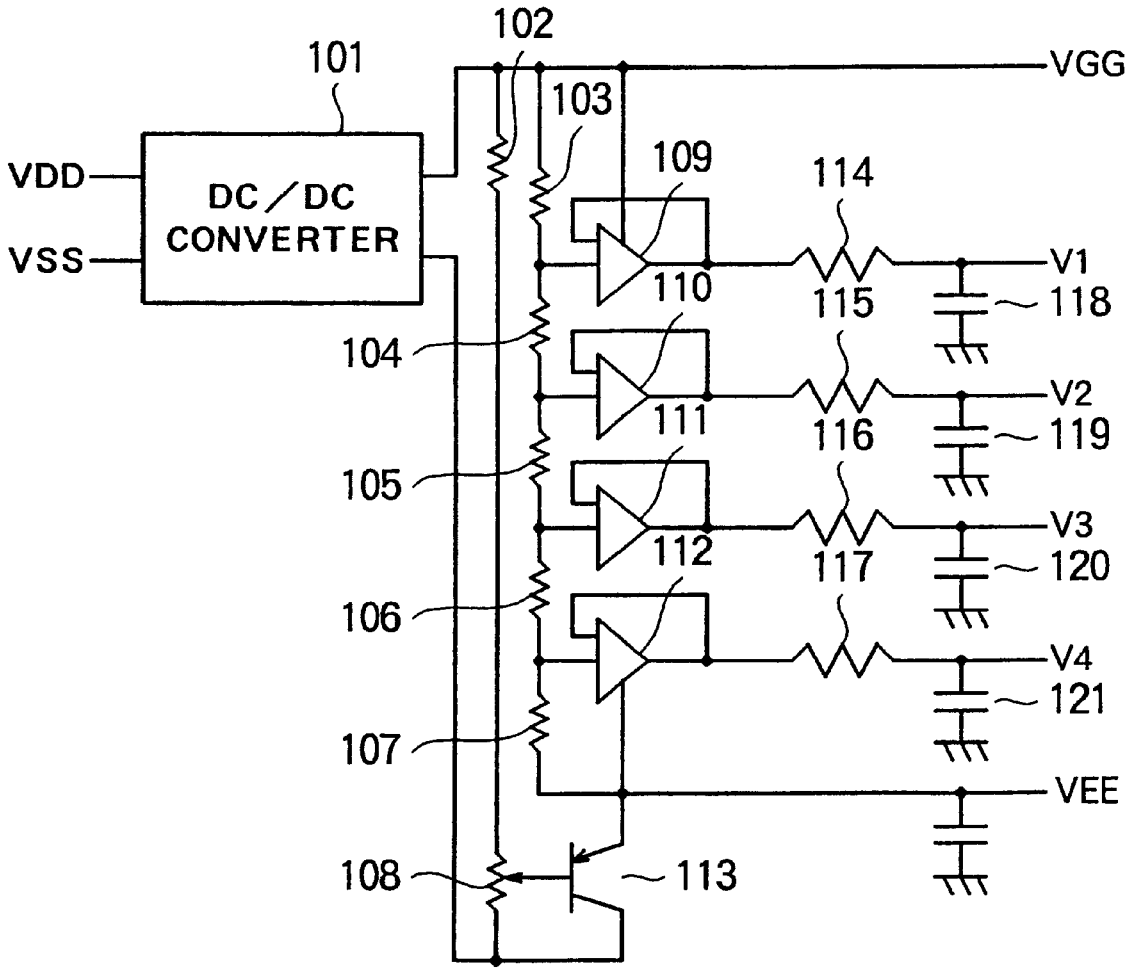
FIG. 9 is a circuit diagram showing the arrangement of a power supply circuit for generating voltages V1 to V4 to be supplied to the liquid crystal drive circuit shown in FIG. 8.

FIG. 1 shows the arrangement of a liquid crystal drive circuit according to the first embodiment. In this embodiment, a clock control circuit 12 and selection control circuit 21 as control circuits are added to the circuit shown in FIG. 8. The waveforms of a clock CLK, input signal IN, and output voltages OUT1 to OUT160 in normal operation after the power supply is turned on and the power supply voltage becomes stable are as shown in the timing chart in FIG. 2.

The selection control circuit 21 comprises a NAND gate NA2 and inverter IN5. The NAND gate NA2 receives signals Q157 to Q160 output from shift register units 111 included in four blocks BL157 to BL160 from the final stage, and outputs a selection control signal S1. The inverter IN5 receives and inverts the signal S1, and outputs an inverted selection control signal /S1.

The clock control circuit 12 has inverters IN2 to IN4, NOR gate NR1, and NAND gate NA1. The circuit 12 receives the inverted selection control signal /S1 and clock CLK, and outputs signals F1 to F4. The NOR gate NR1 receives the inverted selection control signal /S1 and clock CLK, and outputs the signal F2. The NAND gate NA1 receives the clock CLK, and the selection control signal S1 inverted again by the inverter IN2, and outputs the signal F3. Furthermore, the inverter IN3 outputs the signal F1 by inverting the signal F2, and the inverter IN4 outputs the signal F4 by inverting the signal F3. The same reference numerals in FIG. 1 denote the same parts as those in FIG. 8, and a detailed description thereof will be omitted.

Figure 2:
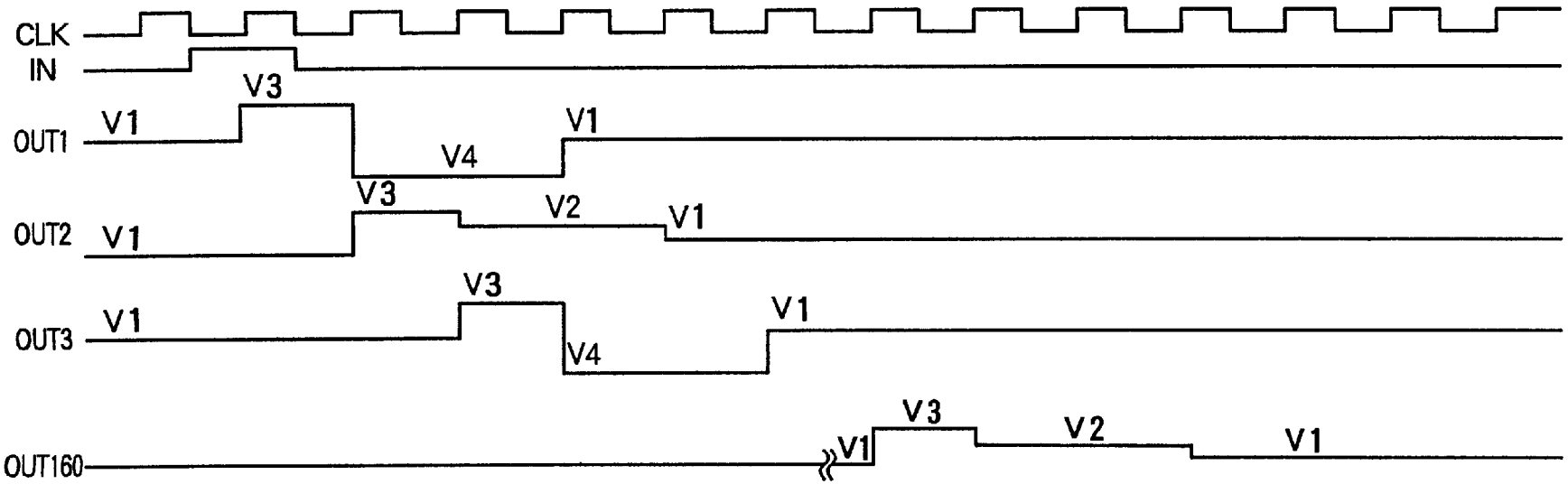
FIG. 2 is a timing chart showing the waveforms of the respective signals in the liquid crystal drive circuit shown in FIG. 1.

The operation of this embodiment with the above arrangement will be explained below. In this embodiment, an input signal IN which remains high for one period of the clock CLK is input, as shown in FIG. 2.

The output signals Q157 to Q160 output from shift register units 111 in the four blocks BL157 to BL160 in the final stage of the blocks BL1 to BL160 are input to the selection control circuit 21. The output signals Q157 to Q160 are input to the NAND gate NA2, and when all the signals Q157 to Q160 are high, the selection control circuit 21 outputs a high-level inverted selection control signal /S1.

When the high-level inverted selection control signal /S1 is input to the clock control circuit 12, the NOR gate NR1 outputs a low-level signal F2 irrespective of input of the clock CLK, and the NAND gate NA1 outputs a high-level signal F3. Furthermore, the signal F2 is inverted by the inverter IN3 to output a high-level signal F1, and the signal F3 is inverted by the inverter IN4 to output a low-level signal F4.

When these signals F1 to F4, and the input signal IN are input to each shift register unit 111, only clocked inverters CIN51 and CIN52 of clocked inverters CIN51 to CIN54 are turned on, and operate as an inverter array including four inverters together with inverters IN52 and IN53. As a result, the shift register units 111 of all the blocks BL1 to BL160 output low-level signals Q1 to Q160.

When the output signals Q1 to Q160 of all the shift register units 111 go low, if an output selection circuit 112 as a logic circuit in each of the blocks BL1 to BL160 receives a low-level frame signal FR, a NAND gate NA63 alone outputs a low-level signal; if the circuit 112 receives a high-level frame signal FR, a NAND gate NA64 alone outputs a low-level signal. Hence, when a low-level frame signal FR is input, a high-level switching control signal SEL3, which has been inverted by an inverter IN63, is output; when a high-level frame signal FR is input, a high-level control signal SEL4 from an inverter IN64 is output.

When the control signal SEL3 or SEL4 is high, an output buffer 113 selects the voltage V2 or V1, and outputs the selected voltage as the output voltages OUT1 to OUT160. Since the voltages V2 or V1 are non-display voltages, the liquid crystal panel is set in a non-display state.

When at least one of the outputs Q157 to Q160 of the shift register units 111 in the blocks BL157 to BL160 goes low, the selection circuit 21 outputs a low-level inverted selection control signal /S1. In this case, the clock control circuit 12 outputs signals F1 and F4 in phase with the clock CLK, and inverted signals F2 and F3. After an elapse of a given period of time from power ON, the shift register units 111 receive an input signal IN carrying data and the signals F1 to F4. The shift register units 111 sequentially shift the input signal IN in accordance with the clock CLK and output it as signals Q1 to Q160. As a result, the output buffers 113 in the blocks BL1 to BL160 select one of the voltages V1 to V4 in accordance with the input signal IN, and output the selected voltages as output voltages OUT1 to OUT160.

To restate, according to this embodiment, when all the output signals Q157 to Q160 from the four blocks BL157 to BL160 from the final stage are high, the non-display voltage V1 or V2 is output as all the output voltages OUT1 to OUT160, and the liquid crystal panel is set in the non-display state during this interval. In the circuit shown in FIG. 8, as described above, when the output signal Q of each shift register unit assumes a value that outputs the voltage V3 or V4 corresponding to the display voltage of the liquid crystal panel, the liquid crystal panel is turned on, thus posing the problems of an increase in consumption power, and a decrease in rise speed of the output voltages Q1 to Q160 due to formation of a current path.

By contrast, in this embodiment, when all the continuous 4-bit signals Q157 to Q160 are high, it is determined that such bits have been generated in the process of stabilizing the power supply voltage after power ON, and an extraneous current path may form. In such case, all the output voltages OUT1 to OUT160 are forcibly set at the non-display voltage V1 or V2, thus setting the liquid crystal panel in a non-display state. In this way, the consumption power can be reduced, and the rise speed of the output voltages OUT1 to OUT160 for liquid crystal display can be increased by preventing generation of a wasteful current path. Furthermore, in this embodiment, the above-mentioned control can be done without supplying any control signals from an external device. Hence, the device arrangement is simple, and can be realized by adding the clock control circuit 12 and selection control circuit 21 to an existing liquid crystal drive circuit.

In this embodiment, the output signals Q157 to Q160 from the shift register units 111 in the four blocks BL157 to BL160 in the final stage are used. After the power supply voltage has become stable and normal operation starts, the clock CLK often remains high continuously for two periods. In that event, to ensure normal operation, when all the 4-bit signals are high, such period is determined to be the period in which the power supply voltage is not stable after power ON. Also, the signals Q157 to Q160 from the four blocks in the final stage of the blocks BL1 to BL160 are used. This is so because the power supply voltage has not reached a prescribed level and normal operation has not started until the output voltages OUT1 to OUT160 from all the blocks BL1 to BL160 become stable, and the values Q157 to Q160 output from the shift register units in the blocks BL157 to BL160 that require longest shift time must be checked.

Figure 3:
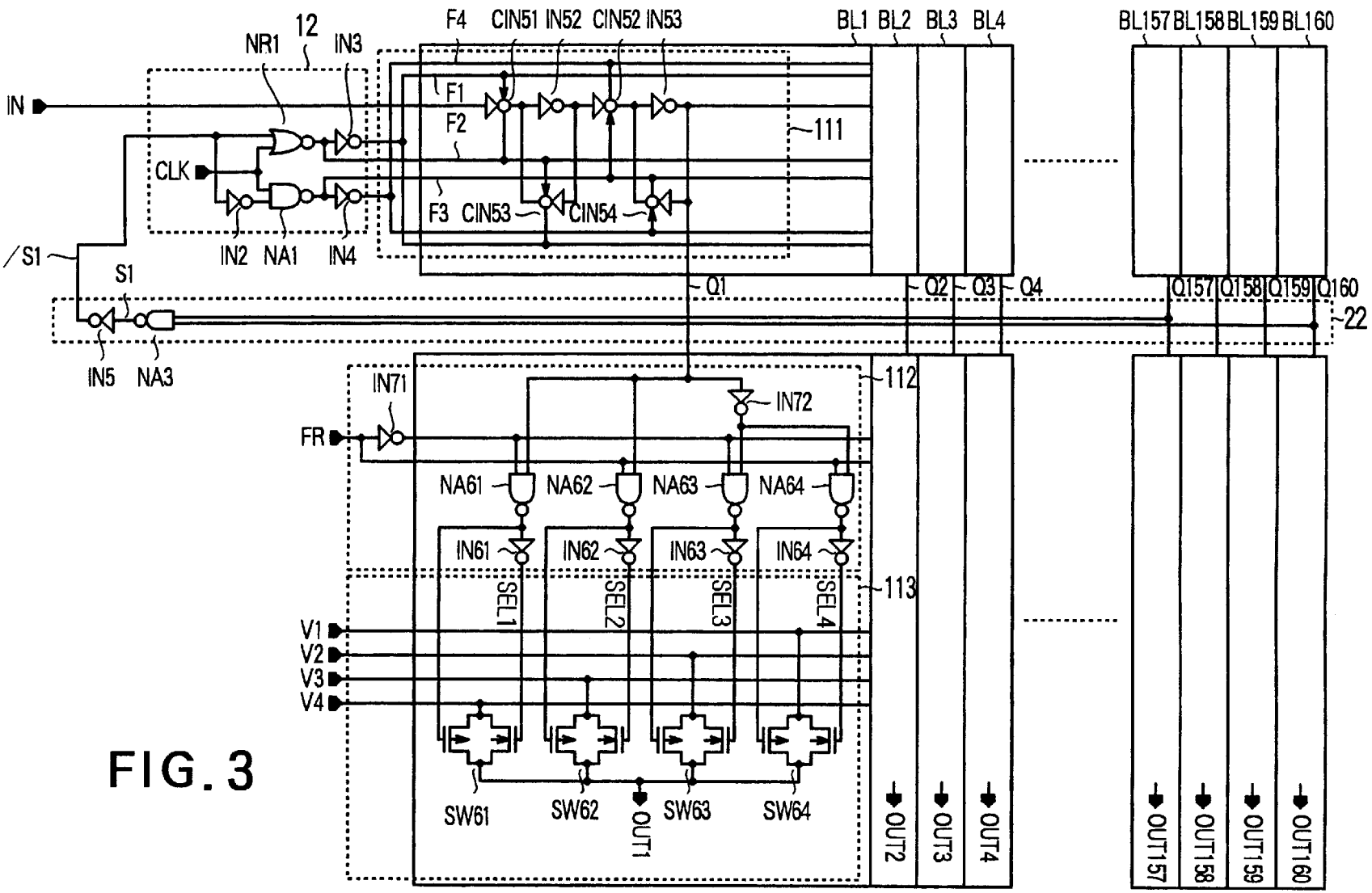
FIG. 3 is a circuit diagram showing the arrangement of a liquid crystal drive circuit according to the second embodiment of the present invention.

A liquid crystal drive circuit according to the second embodiment of the present invention comprises the arrangement shown in FIG. 3. In the first embodiment, when an input signal IN which remains high for one period of the clock CLK is input, and all the output signals Q157 to Q160 from the shift register units 111 in the blocks BL157 to BL160 for the final four bits are at high level, the non-display voltage V1 or V2 is output as all the output voltages OUT1 to OUT160.

Figure 4:
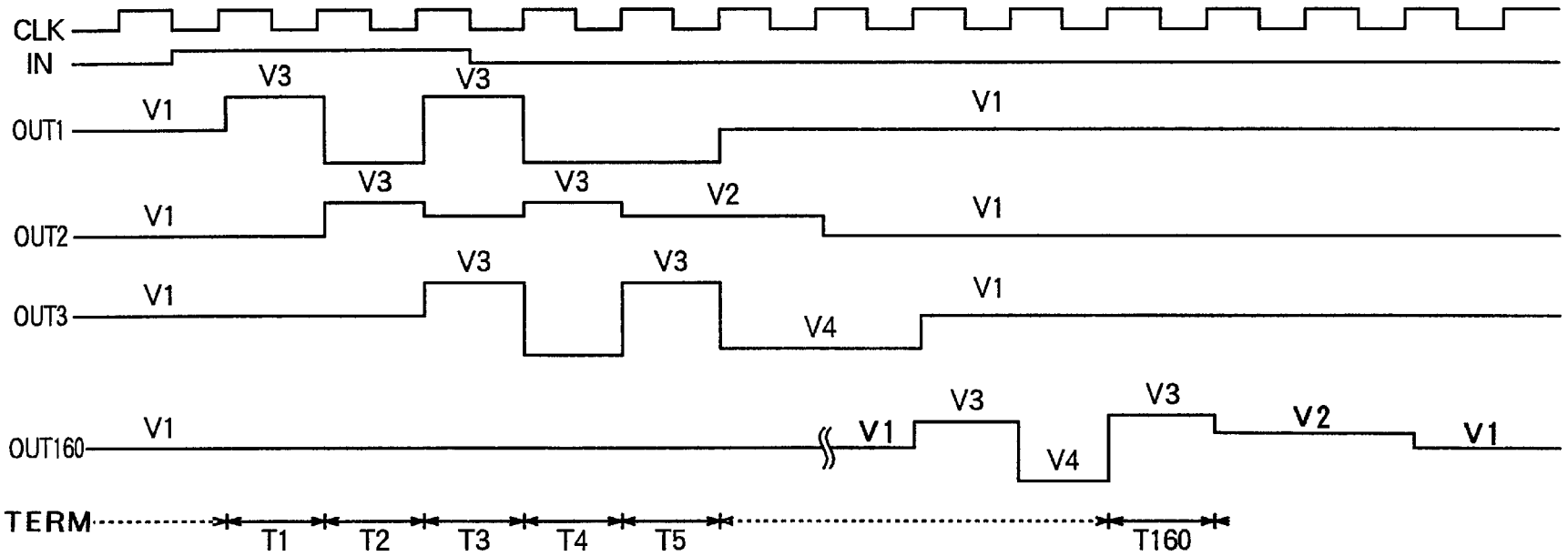
FIG. 4 is a timing chart showing the waveforms of the respective signals in the liquid crystal drive circuit shown in FIG. 3.

On the contrary, in the second embodiment, as shown in FIG. 4, when an input signal IN which remains high for three periods of the clock CLK is input, and both the output signals Q157 and Q160 from the shift register units 111 in the first and last blocks BL157 and BL160 of the blocks BL157 to BL160 for the last four bits are at high level, the non-display voltage V1 or V2 is output as all the output voltages OUT1 to OUT160, unlike in the first embodiment. More specifically, the signals Q157 and Q160 are input to a NAND gate NA3 in a selection control circuit 22. The same reference numerals in this embodiment denote the same parts as those in the first embodiment, and a detailed description thereof will be omitted.

In this embodiment, in normal operation after the power supply voltage has become stable, since the input signal IN remains high continuously for three periods of the clock, as shown in FIG. 4, normal operation must be prevented from being disturbed in that event. In normal operation, output voltages OUT1 and OUT3 may go high (display voltage V3), as indicated by, e.g., a period T3 in FIG. 4, but the output voltages OUT157 and OUT160 do not go high at the same time. Hence, in case this happens, it is determined to be abnormal operation during the period in which the power supply voltage is not stable yet, and all the output voltages OUT1 to OUT160 are set at a non-display voltage V1 or V2, thereby reducing the consumption power and shortening the rise time of the output voltages OUT1 to OUT160.

A liquid crystal display system according to an embodiment of the present invention will be explained below.

Figure 5:
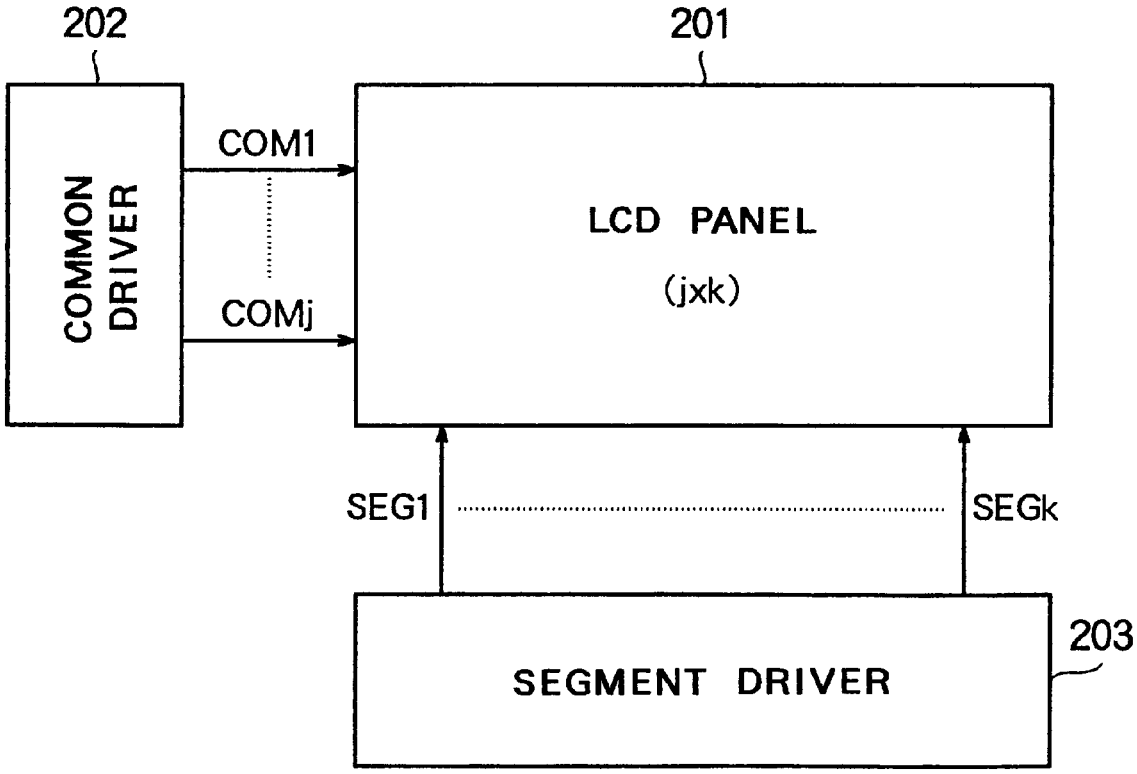
FIG. 5 is a block diagram showing the arrangement of a liquid crystal display system according to an embodiment of the present invention.

FIG. 5 shows the arrangement of the liquid crystal display system according to the embodiment of the present invention. This system comprises an LCD (liquid Crystal Device) panel 201, common voltage generation circuit (COMMON driver) 202, and segment voltage generation circuit (SEGMENT driver) 203.

The LCD panel 201 is the same as that normally used, and a liquid crystal is sandwiched between segment electrodes and common electrodes arranged in units of j×k (j and k are integers) pixels (segments). The LCD panel 201 displays upon application of common voltages COM1 to COMj (j is an integer equal to or larger than 1) to the common electrodes, and segment voltages SEG1 to SEGk to the segment electrodes.

Figure 6:
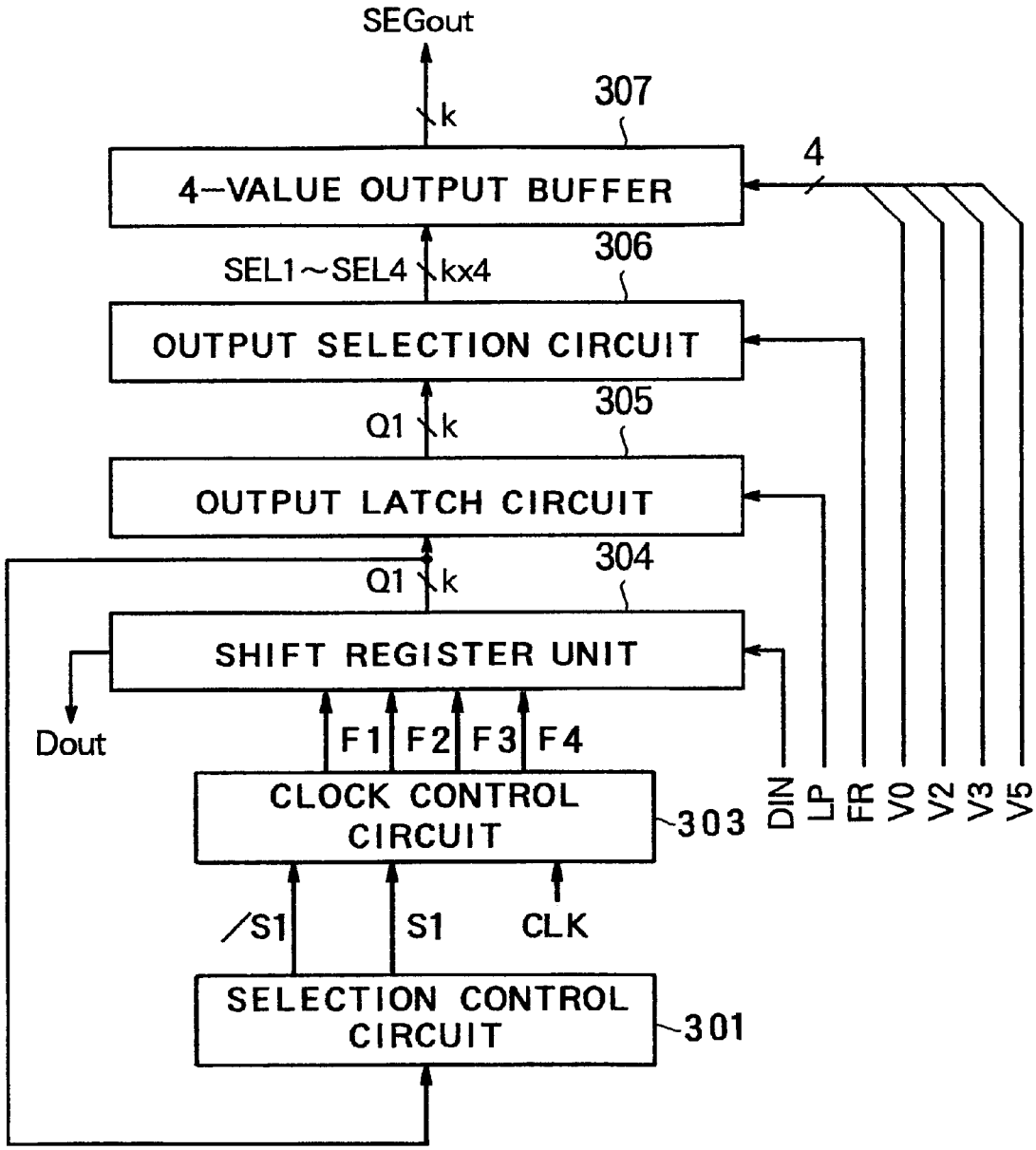
FIG. 6 is a block diagram showing the arrangement of a segment voltage generation circuit in the liquid crystal display system shown in FIG. 5.

The SEGMENT driver 203 has an arrangement shown in FIG. 6. This circuit arrangement is basically the same as that of the liquid crystal drive circuit according to the embodiment of the present invention. In this embodiment, the SEGMENT driver 203 has k blocks.

A selection control circuit 301 receives the outputs from in four blocks from, e.g., the final stage of a shift register unit 304, as described above, and outputs a low-level selection control signal S1 or high-level inverted selection control signal /S1 when all the received signals are high.

A clock control circuit 303 receives a clock CLK, and the output from the selection control circuit 301. Upon reception of a low-level signal S1 or high-level signal /S1, the clock control circuit 303 outputs signals F1 to F4 that make the shift register unit 304 operate as an inverter array.

The shift register unit 304 receives an input signal DIN and signals F1 to F4, and outputs a signal Q1, and an output signal $D_{out}$ of the shift register final stage. In the SEGMENT driver 203, the signal Q1 is normally supplied to an output latch circuit 305. The output latch circuit 305 has, e.g., a shift register configuration. The circuit 305 temporarily latches the signal Q1 in accordance with the timing of a latch clock LP, and then outputs the latched signal.

An output selection circuit 306 receives a frame signal FR and signal Q1, and outputs switching control signals SEL1 to SEL4. A 4-value output buffer 307 receives four different voltages (V0, V2, V3, V5), and the signals SEL1 to SEL4, and outputs one of these voltages as a segment voltage $SEG_{out}$. In this embodiment, the voltages V2 and V3 correspond to non-display voltages, and the voltages V0 and V5 correspond to display voltages. As described above, when the clock control circuit 303 outputs the signals F1 to F4 that make the shift register unit 304 operate as an inverter array, the 4-valve output buffer 307 outputs to make the liquid crystal panel inactive.

Figure 7:
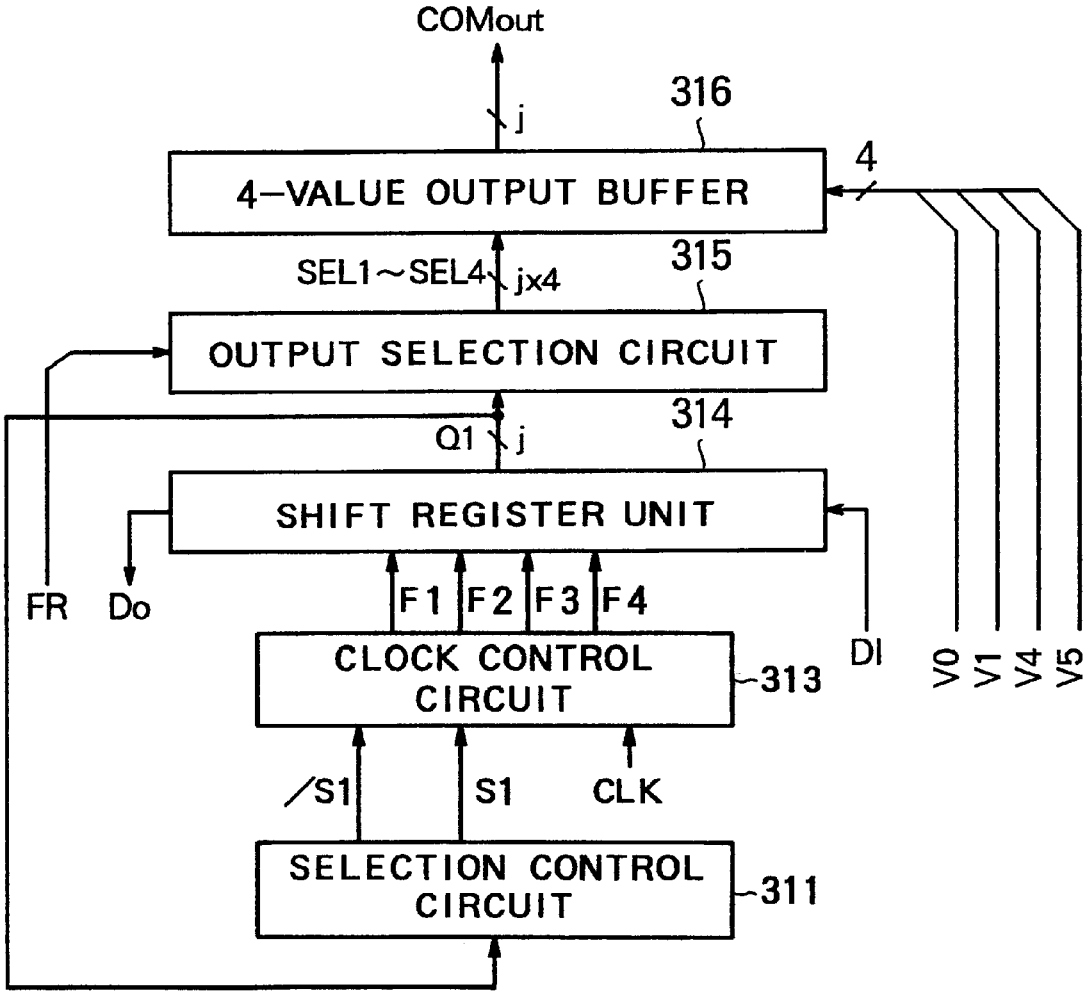
FIG. 7 is a block diagram showing the arrangement of a common voltage generation circuit in the liquid crystal display system shown in FIG. 5.

The COMMON driver 202 has an arrangement shown in FIG. 7. This circuit arrangement is the same as that of the liquid crystal drive circuit according to the embodiment of the present invention, and the COMMON driver 202 has j blocks.

A selection control circuit 311 receives the outputs from four blocks in, e.g., the final stage of a shift register unit 314, as described above, and outputs a low-level selection control signal S1 or high-level inverted selection control signal /S1 when all the received signals are high.

A clock control circuit 313 receives a clock CLK, and the output from the selection control circuit 311. Upon reception of a low-level signal S1 or high-level signal /S1, the clock control circuit 303 outputs signals F1 to F4 that make the shift register unit 314 operate as an inverter array.

The shift register unit 314 receives an input signal DI and the signals F1 to F4, and outputs a signal Q1 and the output signal DO from the shift register final stage.

An output selection circuit 315 receives a frame signal FR and the signal Q1, and outputs switching control signals SEL1 to SEL4. A 4-valve output buffer 316 receives four different voltages (V0, V2, V3, V5), and the signals SEL1 to SEL4, and outputs one of these voltages as a common voltage $COM_{out}$. As described previously, when the clock control circuit 313 outputs the signals F1 to F4 that make the shift register unit 304 operate as an inverter array, the 4-valve output buffer 316 outputs to make the liquid crystal panel inactive. In this circuit, the voltages V1 and V4 correspond to non-display voltages, and the voltages V0 and V5 correspond to display voltages. Also, the voltages (V0, V1, V4, V5) in FIG. 7 respectively correspond to the voltages (V3, V1, V2, V4) in FIG. 2.

The SEGMENT driver 203 comprises the output latch circuit 305 but the COMMON driver 202 has no latch circuit. However, both the drivers 202 and 203 may comprise output latch circuits, or neither of them may comprise output latch circuits.

The above-mentioned embodiments are merely examples, and do not limit the present invention. For example, the present invention is not limited to the arrangement of the selection control circuit 21 and clock control circuit 12 shown in FIG. 1 or 2, but may use any other arrangements as long as control is made to determine an operation error when the output signals from predetermined shift register units are high, and to set all the output voltages OUT at non-display voltages.

Figure 10:
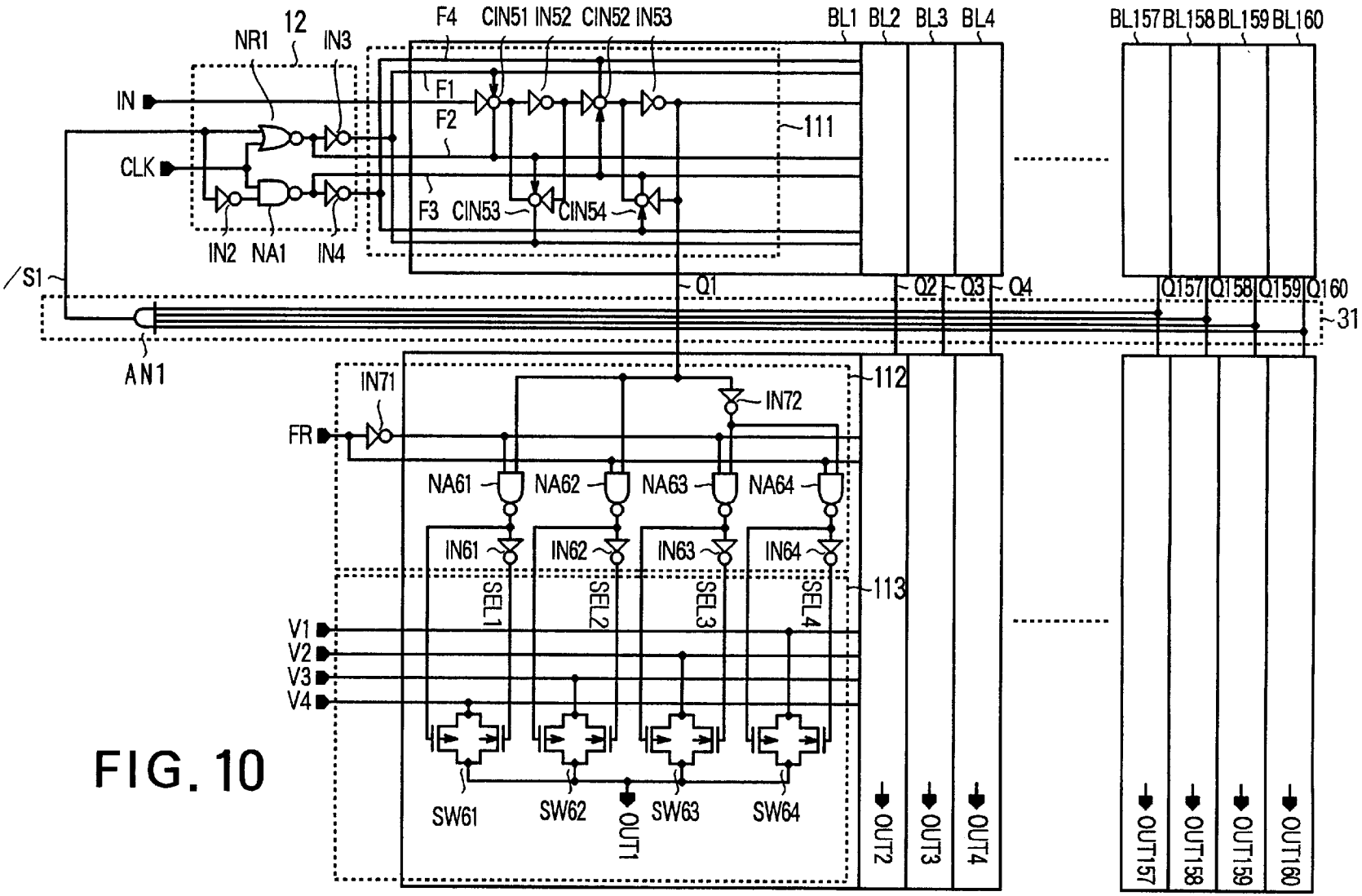
FIG. 10 is a circuit diagram showing the arrangement of a liquid crystal drive circuit according to one of the modified first embodiment of the present invention.
Figure 11:
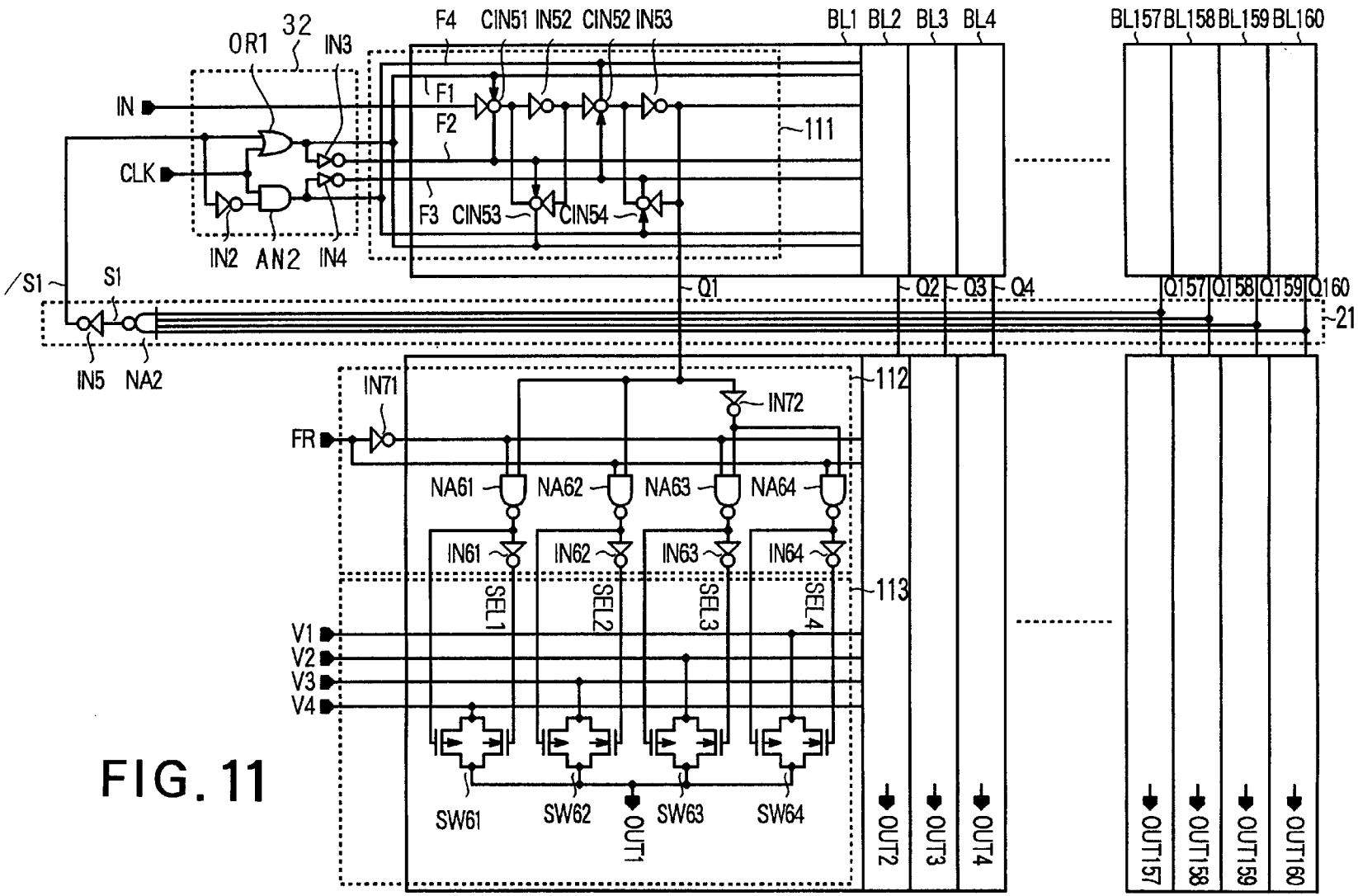
FIG. 11 is a circuit diagram showing the arrangement of a liquid crystal drive circuit according to another modified first embodiment of the present invention.

FIG. 10 shows one of the modified circuit configuration of the selection control circuit 31 having an AND gate AN1 instead of the NAND gate NA2 and the inverter IN5 included in the circuit 21 shown in FIG. 1. Furthermore, the circuit configuration of the clock control circuit 12 shown in FIG. 1 can be modified as the circuit 32 shown in FIG. 11, which has an OR gate OR1, an AND gate AN2 and inverters IN2–IN4.

What is claimed is:

1. A liquid crystal drive circuit for driving a liquid crystal panel, comprising:

a shift register unit for receiving an input signal and clock, and outputting a signal obtained by shifting the input signal on the basis of the clock;

an output selection circuit for receiving the signal output from said shift register unit, and a frame signal, and outputting a switching control signal;

an output buffer for receiving the switching control signal, and at least two different voltages, and selecting and outputting one of the input voltages on the basis of the switching control signal;

a selection control circuit for receiving the signal output from said shift register unit, and for, when the signal has a predetermined value, judging that an operation is abnormal and generating a selection control signal; and a clock control circuit for, when said selection control circuit generates the selection control signal, inputting a signal having a given value to said shift register unit in place of the clock to make said shift register unit operate as an inverter array.

2. A circuit according to claim 1, wherein said selection control circuit judges that an operation is abnormal and generates the selection control signal when a plurality of predetermined signals output from said shift register unit assume values which make said output buffer output a display voltage for setting the liquid crystal panel in a display state.

3. A circuit according to claim 1, wherein said selection control circuit includes an AND gate or a NAND gate which receives a plurality of predetermined signals output from said shift register unit, and outputs the selection control signal when all the input signals have values for making the liquid crystal panel display.

4. A circuit according to claim 3, wherein said clock control circuit includes an OR gate or a NOR gate for receiving the selection control signal output from said selection control circuit, and the clock, and an AND gate or a NAND gate for receiving a signal obtained by inverting a logic level of the selection control signal, and the clock, and when said OR gate or NOR gate and said AND gate or NAND gate receive the selection control signal from said selection control circuit, said OR gate or NOR gate and said AND gate or NAND gate output signals having the given value to said shift register unit.

5. A liquid crystal drive circuit for driving a liquid crystal panel, comprising:

a first block having a first shift register unit for receiving an input signal and a clock, and outputting a signal obtained by shifting the input signal on the basis of the clock, a first output selection circuit for receiving the signal output from said first shift register unit and a frame signal, and outputting a switching control signal, and a first output buffer for receiving the switching control signal output from said first output selection circuit, and at least two different voltages, and selecting and outputting one of the input voltages on the basis of the switching control signal output from said first output selection circuit;

a second block having a second shift register unit for receiving the signal output from said first shift register unit of said first block, and the clock, and outputting a signal obtained by shifting the signal output from said first shift register unit on the basis of the clock, a second output selection circuit for receiving the signal output from said second shift register unit and a frame signal, and outputting a switching control signal, and a second output buffer for receiving the switching control signal output from said second output selection circuit, and at least two different voltages, and selecting and outputting one of the input voltages on the basis of the switching control signal output from said second output selection circuit;

. . . , an n-th block having an n-th shift register unit for receiving the signal output from an (n−1)-th shift register unit (n is an integer not less than 2) of an (n−1)-th block, and the clock, and outputting a signal obtained by shifting the signal output from the (n−1)-th shift register unit on the basis of the clock, an n-th output selection circuit for receiving the signal output from said n-th shift register unit and a frame signal, and outputting a switching control signal, and an n-th output buffer for receiving the switching control signal output from said n-th output selection circuit, and at least two different voltages, and selecting and outputting one of the input voltages on the basis of the switching control signal output from said n-th output selection circuit;

a selection control circuit for receiving the signal output from at least one of said first to n-th shift register units, and for, when the received signal has a predetermined value, judging that an operation is abnormal and generating a selection control signal; and a clock control circuit for, when said selection control circuit generates the selection control signal, inputting a signal having a given value to said shift register unit in place of the clock, and making said first shift register unit operate as an inverter array.

6. A circuit according to claim 5, wherein said selection control circuit receives signals output from the m-th (m is an integer not less than 1 and not more than n−1) to n-th shift register units, and judges that an operation is abnormal and generates a selection control signal when all the received signals have values for making the m-th to n-th output buffers in the corresponding blocks output display voltages for setting the liquid crystal panel in a display state.

7. A circuit according to claim 5, wherein said selection control circuit includes an AND gate or a NAND gate which receives signals output from the m-th to n-th shift register units, and outputs the selection control signal when all the input signals have values for making the liquid crystal panel display.

8. A circuit according to claim 7, wherein said clock control circuit includes an OR gate or a NOR gate for receiving the selection control signal output from said selection control circuit, and the clock, and an AND gate or a NAND gate for receiving a signal obtained by inverting a logic level of the selection control signal, and the clock, and when said OR gate or NOR gate and said AND gate or NAND gate receive the selection control signal from said selection control circuit, said OR gate or NOR gate and said AND gate or NAND gate output signals having the given value to said first shift register unit.

9. A liquid crystal display circuit comprising:

a shift register unit having a first clocked inverter, an operation state of which is switched on the basis of a first clock, and which receives an input signal, a first inverter for receiving an output from said first clocked inverter, a second clocked inverter, an operation state of which is switched on the basis of a second clock, and which receives an output from said first inverter, a second inverter for receiving an output from said second clocked inverter, a third clocked inverter, an operation state of which is switched on the basis of the first clock, and input and output terminals of which are respectively connected to output and input terminals of said first inverter, and a fourth clocked inverter, an operation state of which is switched on the basis of the second clock, and input and output terminals of which are respectively connected to output and input terminals of said second inverter, said shift register unit outputting a first signal from said second inverter;

an output selection circuit having a first NAND gate for receiving an inverted frame signal obtained by inverting a frame signal, and the first signal, a second NAND gate for receiving the frame signal and the first signal, a third NAND gate for receiving the inverted frame signal and an inverted first signal obtained by inverting the first signal, and a fourth NAND gate for receiving the frame signal, and the inverted first signal;

an output buffer having a first switching element, an ON/OFF state of which is switched on the basis of an output from said first NAND gate, and which outputs a first voltage when it is ON, a second switching element, an ON/OFF state of which is switched on the basis of an output from said second NAND gate, and which outputs a second voltage when it is ON, a third switching element, an ON/OFF state of which is switched on the basis of an output from said third NAND gate, and which outputs a third voltage when it is ON, and a fourth switching element, an ON/OFF state of which is switched on the basis of an output from said fourth NAND gate, and which outputs a fourth voltage when it is ON, said output buffer selecting and outputting one of the first, second, third, and fourth voltages on the basis of the outputs from said first, second, third, and fourth NAND gates;

a selection control circuit for receiving the first signal output from said shift register unit, and for, when the first signal assumes a predetermined value, determining abnormal operation and generating a selection control signal; and a clock control circuit for, when said selection control circuit generates the selection control signal, inputting signals having given values to said shift register unit in place of the first and second clocks respectively so as to make said shift register unit operate as an inverter array.

10. A circuit according to claim 9, wherein said selection control circuit judges that an operation is abnormal and generates the selection control signal when a plurality of predetermined first signals output from said shift register unit assume values which make said output buffer output a display voltage for setting the liquid crystal panel in a display state.

11. A circuit according to claim 10, wherein said selection control circuit includes an AND gate or a NAND gate which receives a plurality of predetermined first signals output from said shift register unit, and outputs the selection control signal when all the input first signals have values for making the liquid crystal panel display.

12. A circuit according to claim 11, wherein said clock control circuit includes an OR gate or a NOR gate for receiving the selection control signal output from said selection control circuit, and the clock, and an AND gate or a NAND gate for receiving a signal obtained by inverting a polarity of the selection control signal, and the clock, and when said OR gate or NOR gate and said AND gate or NAND gate receive the selection control signal from said selection control circuit, said OR gate or NOR gate and said AND gate or NAND gate output signals having the given value to said shift register unit.

13. A liquid crystal display circuit for driving a liquid crystal panel, comprising:

a first block having a first shift register unit for receiving an input signal and a clock, and outputting a signal obtained by shifting the input signal on the basis of the clock, a first output selection circuit for receiving the signal output from said first shift register unit and a frame signal, and outputting a switching control signal, and a first output buffer for receiving the switching control signal output from said first output selection circuit, and at least two different voltages, and selecting and outputting one of the input voltages on the basis of the switching control signal output from said first output selection circuit;

a second block having a second shift register unit for receiving the signal output from said first shift register unit of said first block, and the clock, and outputting a signal obtained by shifting the signal output from said first shift register unit on the basis of the clock, a second output selection circuit for receiving the signal output from said second shift register unit and a frame signal, and outputting a switching control signal, and a second output buffer for receiving the switching control signal output from said second output selection circuit, and at least two different voltages, and selecting and outputting one of the input voltages on the basis of the switching control signal output from said second output selection circuit;

. . . , an n-th block having an n-th shift register unit for receiving the signal output from an (n−1)-th shift register unit (n is an integer not less than 2) of an (n−1)-th block, and the clock, and outputting a signal obtained by shifting the signal output from the (n−1)-th shift register unit on the basis of the clock, an n-th output selection circuit for receiving the signal output from said n-th shift register unit and a frame signal, and outputting a switching control signal, and an n-th output buffer for receiving the switching control signal output from said n-th output selection circuit, and at least two different voltages, and selecting and outputting one of the input voltages on the basis of the switching control signal output from said n-th output selection circuit; and a control circuit for, when all the signals output from a plurality of predetermined shift register units of said first to n-th shift register units assume values for making the output buffers in the blocks corresponding to the plurality of shift register units output display voltages to the liquid crystal panel, controlling to internally convert the output signals from the plurality of shift register units into values that make the output buffers output non-display voltages to the liquid crystal panel.

14. A circuit according to claim 13, wherein the plurality of shift register units are the m-th (m is an integer not less than 1 and not more than n−1) to n-th shift register units.

15. A circuit according to claim 13, wherein said control circuit controls all of said first to n-th shift register units to output signals having values that make all of said first to n-th output buffers output non-display voltages to the liquid crystal panel.

16. A liquid crystal display system comprising:

a liquid crystal panel which has segment electrodes disposed in units of pixels in a matrix, and a common electrode disposed to face the segment electrodes so as to sandwich a liquid crystal therebetween, and operates upon application of a segment voltage to the segment voltages, and a common voltage to the common electrode;

a common voltage generation circuit for receiving at least two different voltages, selecting one of the input voltages, and supplying the selected voltage to said liquid crystal panel as the common voltage; and a segment voltage generation circuit for receiving at least two different voltages, selecting one of the input voltages, and supplying the selected voltage to said liquid crystal panel as the segment voltage, said common voltage generation circuit including:

a shift register unit for receiving an input signal and a clock, and outputting a signal obtained by shifting the input signal on the basis of the clock;

an output selection circuit for receiving the signal output from said shift register unit, and a frame signal, and outputting a switching control;

an output buffer for receiving the switching control signal, and the at least two different voltages, and selecting and outputting one of the input voltages on the basis of the switching control signal;

a selection control circuit for receiving the signal output from said shift register unit, and for, when the signal has a predetermined value, judging that an operation is abnormal and generating a selection control signal; and a clock control signal for, when said selection control circuit generates the selection control signal, inputting a signal having a given value to said shift register unit in place of the clock to make said shift register unit operate as an inverter array, wherein when said clock control circuit outputs the signal having the given value and inputs the signal to said clock control circuit, said common voltage generation circuit outputs a voltage for setting said liquid crystal panel in a non-display state.

17. A system according to claim 16, wherein said selection control circuit judges that an operation is abnormal and generates the selection control signal when a plurality of predetermined signals output from said shift register unit assume values which make said output buffer output a display voltage for setting the liquid crystal panel in a display state.

18. A liquid crystal display system comprising:

a liquid crystal panel which has segment electrodes disposed in units of pixels in a matrix, and a common electrode disposed to face the segment electrodes so as to sandwich a liquid crystal therebetween, and operates upon application of a segment voltage to the segment voltages, and a common voltage to the common electrode;

a common voltage generation circuit for receiving at least two different voltages, selecting one of the input voltages, and supplying the selected voltage to said liquid crystal panel as the common voltage; and a segment voltage generation circuit for receiving at least two different voltages, selecting one of the input voltages, and supplying the selected voltage to said liquid crystal panel as the segment voltage, said segment voltage generation circuit including:

a shift register unit for receiving an input signal and a clock, and outputting a signal obtained by shifting the input signal on the basis of the clock;

an output selection circuit for receiving the signal output from said shift register unit, and a frame signal, and outputting a switching control;

an output buffer for receiving the switching control signal, and the at least two different voltages, and selecting and outputting one of the input voltages on the basis of the switching control signal;

a selection control circuit for receiving the signal output from said shift register unit, and for, when the signal has a predetermined value, judging that an operation is abnormal and generating a selection control signal; and a clock control signal for, when said selection control circuit generates the selection control signal, inputting a signal having a given value to said shift register unit in place of the clock to make said shift register unit operate as an inverter array, is abnormal and generating a selection control signal; and a clock control signal for, when said selection control circuit generates the selection control signal, inputting a signal having a given value to said shift register unit in place of the clock to make said shift register unit operate as an inverter array, wherein when said clock control circuit outputs the signal having the given value and inputs the signal to said clock control circuit, said segment voltage generation circuit outputs a voltage for setting said liquid crystal panel in a non-display state.

19. A system according to claim 18, wherein said selection control circuit judges that an operation is abnormal and generates the selection control signal when a plurality of predetermined signals output from said shift register unit assume values which make said output buffer output a display voltage for setting the liquid crystal panel in a display state.

20. A system according to claim 18, wherein said segment voltage generation circuit further comprises a latch circuit which latches a signal output from said shift register unit.

* * * * *